United States Patent [19]

Griffis

[11] 4,272,903

[45] Jun. 16, 1981

[54] REVOLVER RELOADING DEVICE

[76] Inventor: William T. Griffis, 34122 Seville Pl. #C, Dana Point, Calif. 92629

[21] Appl. No.: 21,980

[22] Filed: Mar. 19, 1979

[51] Int. Cl.[3] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 1,964,171 | 6/1934 | Pflaume | 42/89 |
| 2,396,184 | 3/1946 | Lima | 42/89 |
| 2,488,732 | 11/1949 | Lima | 42/89 |
| 3,150,459 | 9/1964 | Van Schoick | 42/89 |
| 3,503,150 | 3/1970 | Brunhuber et al. | 42/89 |
| 3,769,732 | 11/1973 | Griffis | 42/89 |
| 3,769,733 | 11/1973 | Nelson | 42/89 |

*Primary Examiner*—Charles T. Jordan
*Attorney, Agent, or Firm*—William C. Babcock

[57] ABSTRACT

Disclosed herein is an improved reloading device of the type described in my prior U.S. Pat. No. 3,769,732 wherein the center shaft of a revolver cylinder is utilized to displace a latching mechanism retaining a ring of cartridges by the rims thereof. This latching mechanism is in the form of a slidable center post which in one position will oppose the inward bending of a plurality of cantilevered fingers each provided with a semicircular projection abutting the rim of the cartridges, and which, upon the invert articulation thereof, will release the cartridges for insertion into the cylinder. Included also are spring-loaded carriers conformed to support the foregoing reloading devices and to eject the devices into the hand of the wearer upon release.

5 Claims, 9 Drawing Figures

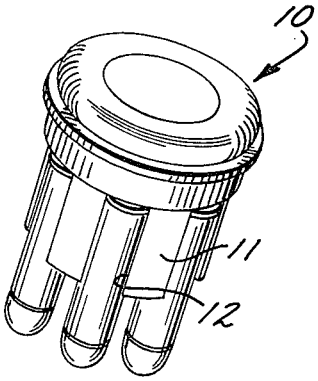
FIG. 1
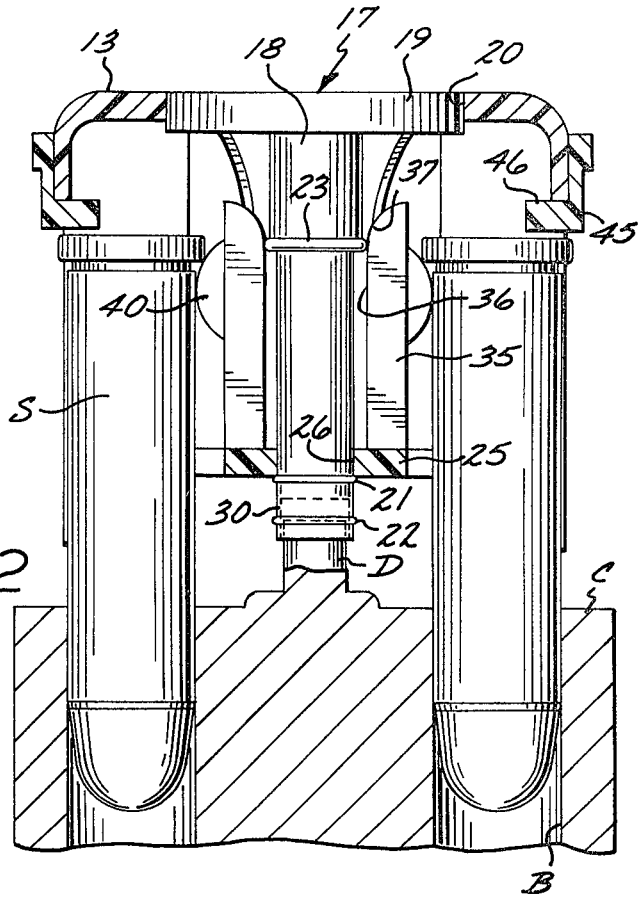
FIG. 2
FIG. 3
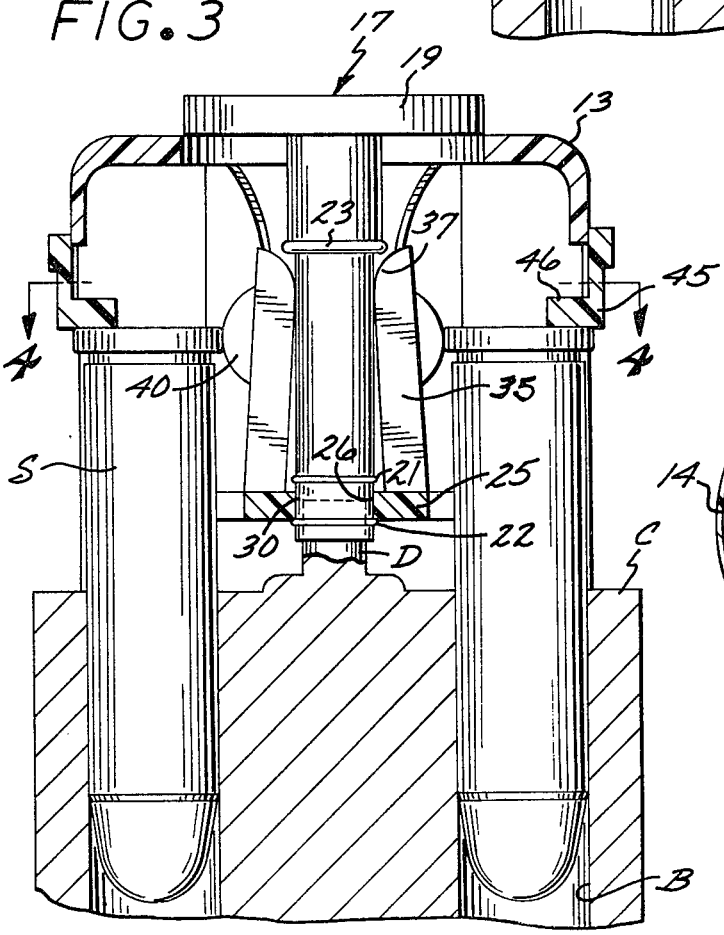
FIG. 4
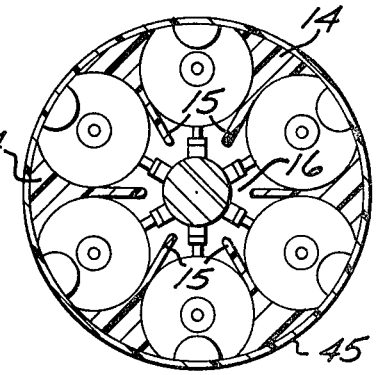

FIG. 5
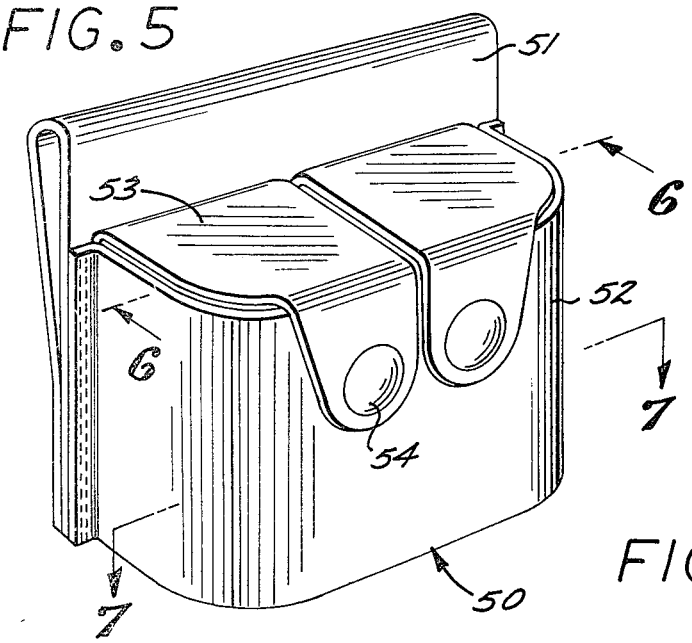
FIG. 8
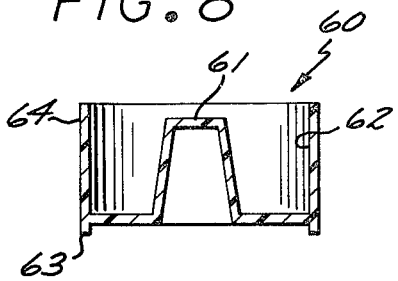
FIG. 9
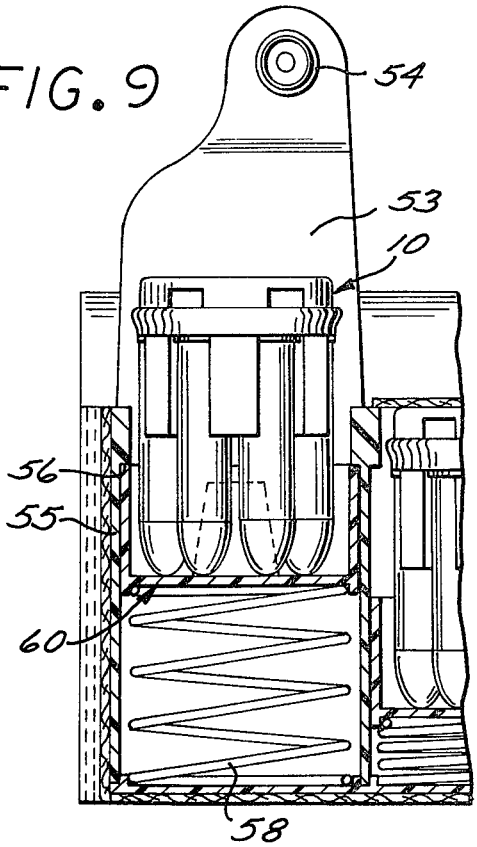
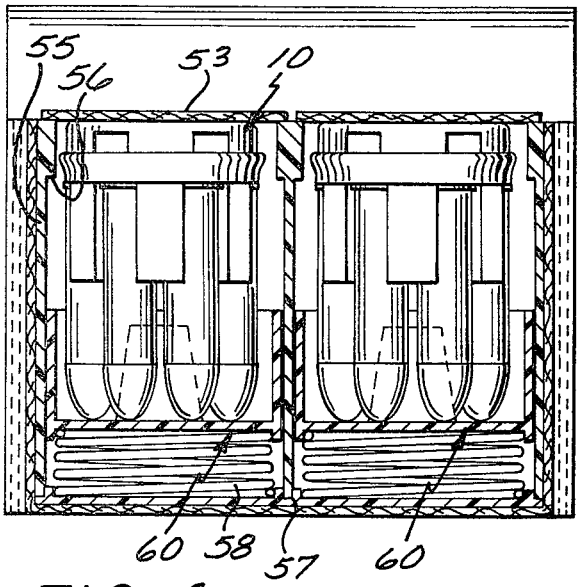
FIG. 6
FIG. 7
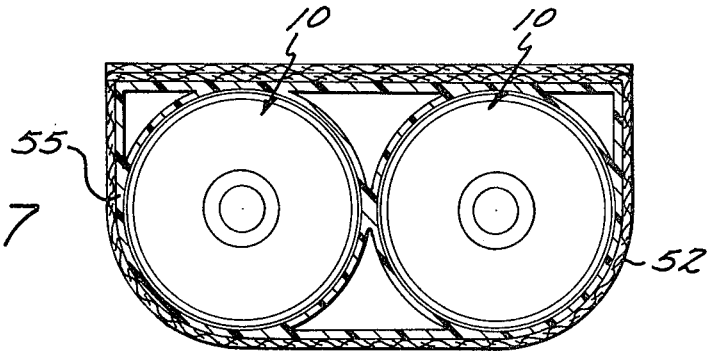

REVOLVER RELOADING DEVICE

BACKGROUND OF THE INVENTION

1. Field of the Invention

The present invention relates to improvements in revolver reloading devices, and more particularly to reloading devices wherein the cylinder support shaft of a revolver is used to effect the release of the cartridges.

2. Description of the Prior Art

In my prior U.S. Pat. No. 3,769,732 I have set out a two-piece reloading device including a central body in which a number of parallel circumferentially spaced bores were formed to store the cartridges which is received in a slidable ring which extends a plurality of fingers into the body to eject the cartridges. Since that time I have found that improvements to this device are possible, and particularly improvements whereby inadvertent dropping of the device will not easily release the cartridges.

More specifically, reloading of revolvers is most frequently done by law enforcement personnel under adverse conditions often leading to inadvertent dropping of the reloading device which, upon sufficient impact, could release the cartridges. In this instance the law enforcement officer will then have to take the time to collect the cartridges in order to complete the reloading process. As set out in my prior U.S. patent, the cartridges in the reloading device are arranged in a circumferential ring and it is that ring that I now utilize to best advantage to protect the retaining mechanism against inadvertent articulation.

SUMMARY OF THE INVENTION

Accordingly, it is the general purpose and object of the present invention to provide an improved cartridge retaining device having the mechanism thereof located on the interior of a ring of cartridges aligned for insertion into the revolver cylinder.

Other objects of the invention are to provide a reliable reloading device which, because of its simplicity may be discarded under emergency conditions.

Yet further objects of the invention are to provide a reloading device wherein the support shaft for the revolving cyclinder of a firearm is utilized to effect the unlatching stroke.

Yet additional objects of the invention are to provide a reloading device which is easy to manufacture, convenient in use and requires very little maintenance.

Briefly these and other objects are accomplished within the present invention by providing a cylindrical housing having a plurality of peripherally spaced grooves therein each communicating to a central axial cavity in which a sliding center post is received. Mounted on a center post and engaged by a lower peripheral bead is a slidable latching cage comprising an annular disc from which axially aligned cantelevered fingers are deployed. Each finger terminates in a radius emd opposed by an upper peripheral bead on the exterior of the center post which, when the annular disc is displaced over the lower peripheral bead allows the fingers to flex inward. Each of the fingers is provided with a semi circular retainer aligned to oppose the cartridge rim inserted in the peripherally spaced bores in the housing. Thus, when the cartridges retained in the housing are partly inserted into the bores in the revolver cylinder, the center shaft of the cylinder opposes the center post articulating the center post to advance the lower bead across the annular disc opening to allow retaining fingers to flex inward. The cartridges are then advanced into the cylinder by way of an advancement ring around the exterior of the housing.

The foregoing cartridge assembly may be stored in a belt supported pouch provided with a helical spring at the bottom thereof on which an annularly dished retainer is placed. The cartridge assembly is then placed onto the dish, compressing the helical spring and when the cover of the pouch is released the cartridge assembly is urged outwardly into the palm of the user.

BRIEF DESCRIPTION OF THE DRAWINGS

FIG. 1 is a perspective illustration of a reloading device constructed according to the invention herein;

FIG. 2 is a side view, in section, of the reloading device shown in FIG. 1 positioned for insertion into the cylinder of a revolver;

FIG. 3 is yet another side view, in section, illustrating the translation of the cartridges out of their retaining position;

FIG. 4 is a top view, in section, taken along line 4—4 of FIG. 3;

FIG. 5 is a pouch, shown in perspective, useful in storing the reloading device set out herein;

FIG. 6 is a sectional view of the pouch taken along the line 6—6 of FIG. 5;

FIG. 7 is a sectional top view of the pouch shown in FIG. 5, taken along the line 7—7 therein;

FIG. 8 is a sectional view of an annular spring retainer useful with the inventive pouch disclosed therein; and FIG. 9 is yet another sectional view of the pouch shown in FIG. 5 illustrating the release articulation thereof.

DESCRIPTION OF THE SPECIFIC EMBODIMENT

As shown in FIGS. 1–4 the inventive reloading device, generally designated by the numeral 10, comprises a cylindrical housing 11 provided with a plurality of peripherally spaced grooves 12 each conformed to receive on the interior thereof a shell insertable into the cylinder C of a revolver. More specifically, grooves 12 extend from an upper cap 13 and include on the interior thereof curved separation walls 14 terminating in a plurality of inwardly directed radially aligned webs 15 extending from a central cavity 16. Received on the interior of cavity 16 and concentrically aligned relative the housing 11 is a center post assembly 17 comprising a cylindrical center post 18 terminating at the upper end in a disc 19 which is receivable in a circular opening 20 formed in cap 13.

Center post 18 is provided with a first and second lower peripheral bead respectively shown as beads 21 and 22 and proximate the free end thereof and an upper peripheral bead 23 proximate disc 19. An annular ring 25 is mounted for sliding translation on post 18 being free to articulate between beads 21 and 23. Disc 25 includes an annular opening 26 just smaller than either one of the beads 21 and 22 and force is therefore required to override those beads. Thus the translation of post 18 within the interior of disc 25 can only be achieved by application of force either to the free end thereof or to the face of the end disc 19. To accommodate the force inputs the free end of post 18 is provided with a central cavity 30 into which the center shaft D supporting in rotation the cylinder C may be inserted. When so inserted the alignment of shells S in the peripherally spaced grooves 12 is such as to align the shells with the normally found bores B in the cylinder. To retain the shells in a collected position, disc 25 is provided with a plurality of cantilevered fingers 35 extending upwardly between the aforementioned webs 15 towards the interior of cap 13. Each of the fingers 35 includes an interior edge 36 conformed to abut the aforementioned peripheral bead 23 and is thus supported against inward flexure. The interior edge 36, proximate the free end of fingers 35 is cut along a radius 37 to allow the inward translation of the fingers upon the upward displacement of the center post. Each of the fingers 35 is furthermore provided proximate the exterior edge with a corresponding semicircular cleaner projection 40 which extends into the interior of each groove 12 to engage the rim of the shell or cartidge S.

It is contemplated to form the foregoing structure out of a plastic material by any conventional technique and preferably the technique of injection molding, the plastic material structure providing the necessary elasticity to permit the translation of post 18 and more particularly the bead 21 around the periphery thereof across the annular opening 26 in disc 25. Furthermore, disc 25 may be secured to the aforementioned webs 15 and is thus fixed relative cap 13 in axial translation. Thus, once the center post assembly 17 is displaced to align disc 25 between beads 21 and 22 inward flexing of fingers 25 is then possible. By virtue of this inward flexing, sufficient clearance is provided to either insert or to extract the cartridges across the semi circular projections 40. In order to accommodate for the common extraction of the cartridges S into the bores B of the cylinder C there is provided an extractor ring 45 shaped as a tubular section conformed to translate across the exterior of the housing 11, the tubular section including at the lower edge thereof a plurality of inwardly directed tabs 46 each received in a corresponding groove 12. Thus the tabs 46 oppose the base surface of each shell or cartridge S and when the center post is abutted against the cylinder shaft D application of manual force to ring 45 will both displace the annular disc across the corresponding bead and also advance the shells now free to translate.

By virtue of the same structural features insertion of cartridges into the reloading device 10 is similarly possible. More specifically, upon the displacement of center post 18 to align the annular disc 25 between beads 21 and 22 clearance for flexure is provided to insert the cartridges. Once the cartridges are received the spring bias of the fingers 35 will maintain them in position until manual pressure is applied to the exterior of disc 19, advancing the center post inwardly to oppose by bead 23 any further flexure of the fingers. In this manner both the extraction and the collection of shells in conveniently accommodated in a device inexpensively constructed thus a device which may be conveniently discarded under emergency conditions provides the necessary facilities and features to be reused in tranquil surroundings.

The foregoing reloading device and devices similarly structured may be carried either singly or in plural arrangements by way of a carrier shown in FIGS. 5–9. More specifically, as shown in FIG. 5, a carrying pouch generally designated by the numeral 50 comprises a belt retaining loop 51 onto which a leather pouch 52 is shown. As shown in FIGS. 6 through 9, pouch 52 includes on the interior thereof one or more cylindrical casings 55 each formed as a tubular member having an interior dimension sufficient to accommodate the aforementioned reloading device 10. Cylindrical members 55 furthermore include proximate the upper edge thereof an inwardly directed ledge 56 and a guage by the lower edge thereof a base plate 57. Supported on the base plate 57 is a helical spring 58 which opposes at the other end the underside of an annularly dished spring retainer 60. It is into the annular cavity formed in the upper surface of dish 60 that the free ends of the cartridges S are inserted and the reloading device 10 is pushed in to oppose the spring.

Referring to FIG. 8 the spring retainer 60 comprises a tubular section 64 conformed for receipt on the interiof of the tube segment 55 and translatable therein between the spring compression limits of spring 58 and the interiorly directed ledge 56. The retainer includes in the center thereof a projection 61 which defines together with the exterior wall 64 an annular trough conformed to receive the tips of the cartridges S retained in the reloading device 10. At the lower surface the exterior walls of the tubular segment 64 extend downwardly to form a peripheral lip 63 which engages the upper end of spring 58. Thus a sliding assembly is formed wherein the retainer 60 can translate from the coil bind limits of spring 58 to the stroke limit defined by wedge 56. Referring back to FIG. 5 the pouch 52 is provided with flexible covers 53 terminating in snap fasteners 54 which when fastened bring down the device 10 and the retainer 60 to compress spring 58. When unfastened the spring urges the device outwardly to a position where it can be conveniently grasped by the user. It is contemplated to form a configuration wherein more than one reloading device may be thus stored. In each instance the cover 53 together with its associated snap fastener 54 provide the necessary selection of a particular device. Once selected, the unfastened cover gives the necessary tactile signal to the user when searching for an additional reloading set.

Obviously many modifications and changes may be made to the foregoing description without departing from the spirit of the invention. It is therefore intended that the scope of the invention be determined solely on the claims appended hereto.

I claim:

1. A reloading device for retaining a plurality of cartridges in alignment for receipt in a cylinder of a revolver, which cylinder includes a center shaft, and for releasing said cartridges upon manual application of said reloading device against said center shaft of said cylinder, comprising:

a cylindrical housing conformed as a segment of a cylinder including a cap at one end thereof, a plurality of peripherally spaced grooves formed in the exterior surface of said housing, a central cavity extending axially through the interior of said housing and said cap, said central cavity communicating with said grooves, said grooves being confomred to receive said cartridges therein;

a latching spider received on the interior of said central cavity and including a plurality of flexible latches each aligned to extend into the interior of said grooves for retaining said cartridges therein; and a center post assembly deployed on the interior of said central cavity and adapted for axial articulation therein, said assembly including a radial projection adapted to oppose the releasing flexure of said latches in one axial position thereof and an end fitting adapted to engage the end of said center shaft of said cylinder whereby the axial articulation of said assembly by said shaft from said one axial position will allow for releasing flexure of said latches.

2. Apparatus according to claim 1 further comprising:

an advancing ring deployed for sliding translation around the exterior of said cylindrical housing and including a plurality of inwardly directed extensions each adapted to engage one of said cartridges for providing manual advancement thereof into said cylinder.

3. Apparatus according to claim 2 wherein:

said latching spider comprises an annular disc deployed in said housing in surrounding engagement around said center post assembly, and a plurality of cantelevered fingers extending from said disc in an axial alignment in said grooves each said finger including a latching structure at the free end thereof for engaging a corresponding one of said cartridges.

4. Apparatus according to claim 3 wherein:

said disc is secured to said housing and said center post assembly includes detent means for engaging said ring in said one axial position.

5. Apparatus according to claim 4 wherein:

said housing, spider, center post assembly and advancing ring each comprise plastic material.

* * * * *